United States Patent [19]

Kovacs

[11] 4,435,306

[45] Mar. 6, 1984

[54] STABLE COAL-WATER SUSPENSIONS AND THEIR PREPARATION

[75] Inventor: Geza L. Kovacs, Baltimore, Md.

[73] Assignee: Koal, Inc., Baltimore, Md.

[21] Appl. No.: 317,545

[22] Filed: Nov. 2, 1981

[51] Int. Cl.[3] ..... C10L 1/32

[52] U.S. Cl. ..... 252/173; 252/134; 252/164; 252/363.5; 44/51

[58] Field of Search ..... 44/51; 252/22, 108, 252/133, 134, 164, 173, 311.5, 363.5

[56] References Cited

U.S. PATENT DOCUMENTS

| | | | |
|---|---|---|---|
| 2,668,757 | 2/1954 | Hansley | 44/51 |
| 3,342,733 | 9/1967 | Robbins | 44/51 |
| 3,762,887 | 10/1973 | Clancey | 44/51 |
| 3,996,026 | 12/1976 | Cole | 44/51 |
| 4,164,472 | 8/1979 | Cheng et al. | 44/51 |
| 4,309,191 | 1/1982 | Hiroya | 44/51 |

FOREIGN PATENT DOCUMENTS

| | | |
|---|---|---|
| 2933760 | 3/1981 | Fed. Rep. of Germany . |
| 2947788 | 7/1981 | Fed. Rep. of Germany . |
| 5271507 | 11/1975 | Japan . |

OTHER PUBLICATIONS

Tyler Standard Screen Scale Sieves, Handbook of Chemistry and Physics, p. 3402, 43rd Ed., The Chemical Rubber Pub. Co., Cleveland, Ohio.

Fatty Acids in Soap Oils, Soaps and Detergents, E. G. Thomssen, pp. 4–82, MacNair-Dorland Company, New York, 1949.

*Primary Examiner*—John E. Kittle
*Assistant Examiner*—Hoa Van Le
*Attorney, Agent, or Firm*—Roland H. Shubert

[57] ABSTRACT

A non-settling, coal-water slurry stabilized with an alkali metal soap of a fatty acid. The soap stabilizing agent is preferably prepared by saponification of a fat or fatty oil of either animal or vegetable origin and is diluted with water to the desired concentration without separation of by-products such as glycerine. Thereafter, pulverized coal is added with mixing to form a pumpable slurry which is non-settling at temperatures below the soap gel point.

17 Claims, No Drawings

STABLE COAL-WATER SUSPENSIONS AND THEIR PREPARATION

BACKGROUND OF THE INVENTION

This invention relates to coal-water suspensions or slurries and to methods for their preparation.

More particularly, this invention relates to a non-settling, soap-stabilized coal slurry having pumping and atomization characteristics similar to those of a heavy fuel oil.

There has been in recent years an increasing interest in coal-water slurries both to produce a pipeline transportable mixture and to burn directly in a boiler as a replacement for oil. Technical problems faced in the design of a suitable slurry include the selection of an appropriate coal particle size range and use of an effective but economical stabilizing agent. The capital and operating costs of a slurry preparation plant must also be as low as possible to insure economic feasibility of slurry production. The slurry must be capable of being transported, stored and pumped without losing its fluid characteristics.

Successful, large scale test burns of coal-water slurries in utility boilers have been reported. A number of different coal-water slurry formulations have been developed including some which assertedly contain coal concentrations as high as 60% or greater. Representative prior art includes the following patents.

Schulz et al disclose in U.S. Pat. No. 4,261,701 a suspension of coal in water stabilized by a material resulting from the reaction of polycyclic, polycarboxylic acids, obtained from the oxidation of coal, with a base. The resulting suspensions were reported to be non-settling for as long as 26 days. Alkali metal salts of organic sulfonic acids, particularly sodium lignin sulfonate, have been used to stabilize lignite-water slurries as is described in U.S. Pat. No. 4,104,035. However, the lignite must be subjected to autoclaving at high temperature and pressure for the stabilizing system to be effective.

Oil-coated coal particles have been stabilized in a water suspension using an imidazoline stabilizing agent as is taught in U.S. Pat. No. 3,210,168. Clancy et al in U.S. Pat. No. 3,762,887 obtained a homogeneous, stable coal-water slurry without use of stabilizing agents through selection and control of the coal particle size distribution.

A last patent, U.S. Pat. No. 2,668,757, although directed to carbon-hydrocarbon liquid slurries, is worthy of note. Carbon particles such as petroleum coke of relatively small particle size were dispersed in hydrocarbon liquids including kerosene and industrial white oils to form a non-settling suspension stabilized by an alkali metal soap of a higher fatty acid. The patent teaches that, to be effective, the soap should be formed in situ. That is the soap is formed by reaction of a fatty acid dissolved in the liquid hydrocarbon to react with an alkali metal or with certain alkali metal derivatives such as the alcoholates or amides.

SUMMARY OF THE INVENTION

A non-settling coal-water slurry suitable for firing in boilers or the like is stabilized by the addition of a water soluble soap to the water used in making up the slurry. The soap is preferably prepared by saponification of an appropriate fatty material, such as tallow, with aqueous sodium hydroxide. The resulting saponfied product is diluted with water to obtain the desired soap concentration, generally within the range of about 5% to 15%, and particulate coal is mixed therein to form a suspension. Concentrations of coal as high as 65% by weight are readily pumpable and may be atomized for burning using conventional nozzles. The slurry is stable for an indefinite period at temperatures ranging from freezing to the gel temperature of the soap provided that sufficient free base is present in the slurry to neutralize all leachable coal acids.

Hence, it is an object of this invention to provide stable coal-water slurries.

It is a further object of this invention to provide a process for the production of such slurries.

Yet another object of this invention is to provide a highly concentrated, coal-water slurry which may be pumped using conventional equipment.

DESCRIPTION OF PREFERRED EMBODIMENTS

The stable coal slurry compositions made in accordance with this invention include as necessary components pulverized coal, water, an alkali metal soap of a saponifiable fatty material and sufficient free base to neutralize any acids associated with or released by the coal. Other combustion-modifying or gas cleaning agents may be included in the compositions on an optional basis provided such agents are compatible with the slurry composition. One such gas cleaning agent which may be included in the slurry composition is powdered limestone or other calcium carbonate material which will react, at least in part, with sulfur oxides normally released during coal combustion.

The type or rank of coal appropriate for use in this invention may range from sub-bituminous through anthracite; especially good results being obtained through use of bituminous coals. Particle size or particle size distribution of coal used to formulate the slurries is of little importance to the stability of the slurry. However, all slurry compositions formulated for burning necessarily will have a relatively small particle size both for combustion efficiency and to avoid any plugging of lines and nozzles. A standard air grind coal as used in conventional furnaces burning powdered coal gives completely satisfactory results. Such a ground coal will typically display a size range such that 100% will pass a 60-mesh screen and about 70% will pass a 200-mesh screen. Any solid fuel additive such as limestone incorporated into the slurry composition should display a similar particle size range.

The soap stabilizing agent may be obtained by saponification of any suitable animal or vegtable fat or oil. Particularly suitable animal fats include inedible tallow and grease, lard, fish oils such as menhaden oil and the like. A wide range of vegetable oils including soybean, cotton seed, peanut and similar oils may be used as well but are less preferred primarily for economic reasons.

Saponification is accomplished in conventional fashion by heating the fat or oil with aqueous alkali, preferably sodium hydroxide. It is convenient to utilize the resulting soap solution, without further purification or glycerin separation, as the slurry stabilizing agent. The soap solution resulting from saponification is further diluted with water to a concentration ranging generally between 5% and 15% and this resulting diluted solution comprises the water phase of the coal-water slurry.

Saponification may be accomplished both batchwise and continuously.

Soap solution and pulverized coal are then blended together by mechanical mixing to form a slurry. Coal concentration in the slurry preferably is in excess of 50% by weight and most suitably is as high as possible while maintaining the viscosity sufficiently low as to obtain a pumpable slurry. Most suitably, coal concentration will range from about 55% to 70% by weight.

It is advantageous to use a cleaned coal for preparation of the slurry in order to reduce ash and sulfur to a minimum and to increase the heating value or Btu content of the slurry. A flotation concentrate is especially appropriate as the coal source as such a coal concentrate is already in an appropriate size range for incorporation into the slurry. Additionally, the flotation concentrate may be added to the soap solution as a wet filter cake obviating the need for drying the coal concentrate before burning.

As has been set out previously, both soap concentration and coal concentration must be within certain limits for the resulting slurry to be stable and to have the desired flow properties. Soap concentration in the water phase must be at least about 5% in order to obtain a stable slurry. Soap concentrations of about 15% or greater produce slurries having very poor pumping characteristics. For most applications, a soap concentration in the water phase ranging from about 6% to about 10% is preferred. Especially desirable slurry properties have been obtained at soap concentrations of about 7.5% with Eastern bituminous coal.

Coal concentrations below about 50% tend to produce an unstable slurry. At the same time, coal concentrations must be sufficiently low to allow for pumpability. Maximum coal concentration obtainable while still maintaining adequate pumpability depends to some extent upon the size range and type of coal but a practical maximum is about 70% coal by weight based on the total slurry weight. A preferred coal concentration when using Eastern bituminous coals is in the range of about 60% to 65%.

Most coals contain small amounts of leachable acid. This acid will destabilize a coal slurry made with a neutral soap in a short period of time; on the order of a day or so. Consequently, it is necessary and critical to this invention that sufficient free base be included in the water phase to neutralize all leachable coal acids. The amount of base required is relatively small; generally on the order of about 1000 ppm. The level of free base required will vary depending upon the coal and can be determined easily for any particular coal by simple experimentation.

Coal slurries formulated according to this invention are stable for an extended period of time provided that the gel temperature of the particular soap used is not exceeded. Gel temperatures of most soaps, such as from those animal fats, are in the range of about 100° F. The slurries can be pumped using equipment conventionally used for heavy fuel oils. Atomization for burning can be accomplished using nozzles of the type employed in the burning of heavy fuel oils. Slurry atomization tests using a pneumatic nozzle with a 1/10 inch orifice, for example, produced extremely good atomization with a long nozzle plume. In other instances, however, it may be advantageous to employ burners expressly designed for coal-water slurries.

The following examples set out a number of experimental coal-water slurry formulations together with certain characteristics of those formulations.

EXAMPLE 1

A series of eight soap-stabilized coal-water slurries was prepared using a standard air grind Eastern bituminous coal sized such that 100% passed a 60-mesh screen and 70% passed a 200-mesh screen. Two different soaps were prepared for use as slurry stabilizing agents by batch saponification using aqueous sodium hydroxide as the saponification agent. One of the soaps was prepared from commercial inedible tallow while the other was prepared from yellow grease.

The soap solutions from the saponification reaction were diluted with water to concentrations of 5% and 7.5%. Sufficient sodium hydroxide was added to each soap solution to provide a free base concentration of about 1000 to 1100 ppm. Coal was then added to the soap solution with mechanical mixing in amounts to produce slurries having coal concentrations ranging from 50% to 70% by weight. Individual slurry samples were then placed in cylindrical glass containers and were aged at controlled temperatures for extended time periods to determine their stability. A slurry sample was considered to be stable if no separation of coal from the aqueous phase occurred and if the apparent viscosity of the slurry at the top and the bottom of the container remained essentially equal after a minimum of seven days of aging. Unstable slurries typically displayed a separation of the coal and water phases at the top of the container. Results obtained are set out in the following Table.

TABLE

| SAMPLE NUMBER | COAL (% IN WEIGHT) | SOAP TYPE | SOAP CONCENTRATION (% IN WATER PHASE) | STABILITY 100° F. | STABILITY 90° F. |
|---|---|---|---|---|---|
| 1 | 50 | Tallow | 5 | No | Yes |
| 2 | 50 | Tallow | 7.5 | No | Yes |
| 3 | 60 | Tallow | 5 | No | Yes |
| 4 | 60 | Yellow Grease | 5 | No | No* |
| 5 | 60 | Tallow | 7.5 | Yes | Yes |
| 6 | 60 | Yellow Grease | 7.5 | No | No** |
| 7 | 70 | Tallow | 5 | Yes(?) | Yes(?) |
| 8 | 70 | Tallow | 7.5 | Yes | Yes |

*Not stable at 80° F.
**Stable at 80° F.

As is apparent from a study of the data, stability of the slurries is influenced by storage temperature, by the type of soap used, by the soap concentration, and by the coal loading or concentration within the slurry. Based upon these data and other experimental work as well, the following general conclusions can be drawn. A minimum coal concentration of about 50% is required to form a stable slurry. Maximum coal concentration practicable is on the order of 70% or slightly higher but this maximum is determined not on a stability basis but on a pumpability or handling basis. Soap concentrations of at least about 5% based on the water phase are necessary to produce a stable slurry. Maximum stability temperatures of the coal slurries depend upon soap type and concentration and upon the quality of the soap. Higher quality soaps; i.e., tallow rather than yellow grease, produce overall better slurries.

EXAMPLE 2

A number of slurry compositions were prepared in the manner set out in Example 1 having proportions of coal and soap which would result in stable slurries. The soap solution was neutral and contained no added base. Slurries prepared in this fashion were initially stable but after a period of time as little as 24 hours, partial separation of the coal and water phases occurred. Source of the instability was determined to be the leachable acid contained in the coal.

The coal slurries of this invention are contemplated for use in industrial boilers, commercial heating applications and the like. Properties of the slurries, including coal concentrations, maximum stability temperature and the like will of course be tailored to the particular use. These and similar modifications will be apparent to those skilled in the art and may be practiced within the scope of the appended claims.

I claim:

1. A non-settling fuel composition consisting essentially of a particulate suspension of coal, water and a fatty acid soap, the coal concentration in said composition being at least 50% by weight and the soap concentration in the water phase of said composition being above about 5% by weight, said soap further characterized in having sufficient free base to neutralize all acid associated with or released by said coal.

2. The suspension of claim 1 wherein the concentration of said soap within the water phase ranges from about 5% to about 15%.

3. The suspension of claim 1 wherein said coal is sized such that essentially all coal particles pass a 60-mesh screen.

4. The suspension of claim 3 wherein said coal comprises a flotation concentrate.

5. The suspension of claim 1 wherein said slurry also contains a gas cleaning agent.

6. The suspension of claim 5 wherein said gas cleaning agent is powdered limestone.

7. The suspension of claim 1 wherein said soap is a sodium soap of an animal fat.

8. The suspension of claim 7 wherein said animal fat comprises tallow.

9. The suspension of claim 1 wherein said coal comprises from about 55% to about 70% of the total slurry weight and wherein the concentration of said soap in the water phase ranges from about 6% to about 10%.

10. The suspension of claim 9 wherein said coal is an Eastern bituminous coal wherein said soap concentration in the water phase is about 7.5%; and wherein the concentration of free base in the soap-containing water phase is about 1000 ppm.

11. A method for preparing a fuel composition of coal suspended in water comprising:

saponifying a fatty material by heating said material with an aqueous alkali;

diluting the soap solution produced by saponification with water to obtain a soap concentration ranging from about 5% to about 15%;

adjusting the free alkali content of said diluted soap solution to provide an excess, and mixing pulverized coal with said diluted soap solution in an amount to provide a coal concentration in said composition greater than 50% by weight and to form a pumpable slurry, said excess free alkali being at least sufficient to neutralize all acid associated with or released by said coal.

12. The method of claim 11 wherein said alkali is sodium hydroxide.

13. The method of claim 11 wherein said fatty material is an animal fat.

14. The method of claim 13 wherein said animal fat comprises tallow.

15. The method of claim 11 wherein said diluted soap solution has a soap concentration ranging from about 6% to about 10%.

16. The method of claim 15 wherein said pulverized coal comprises from about 55% to about 70% of said slurry by weight.

17. The method of claim 16 wherein said excess free alkali comprises sodium hydroxide at a concentration of about 1000 ppm in said diluted soap solution.

* * * * *